US012263370B2

(12) United States Patent
Arranz Molero

(10) Patent No.: US 12,263,370 B2
(45) Date of Patent: Apr. 1, 2025

(54) MACHINE FOR SPORTS TRAINING

(71) Applicant: Ignacio Arranz Molero, Valladolid (ES)

(72) Inventor: Ignacio Arranz Molero, Valladolid (ES)

(73) Assignee: Pablo Gonzalez Perez, Shanghai (CN)

( * ) Notice: Subject to any disclaimer, the term of this patent is extended or adjusted under 35 U.S.C. 154(b) by 0 days.

(21) Appl. No.: 16/976,527

(22) PCT Filed: Feb. 21, 2019

(86) PCT No.: PCT/ES2019/070100
§ 371 (c)(1),
(2) Date: Aug. 28, 2020

(87) PCT Pub. No.: WO2019/166678
PCT Pub. Date: Sep. 6, 2019

(65) Prior Publication Data

US 2020/0406086 A1 Dec. 31, 2020

(30) Foreign Application Priority Data

Feb. 28, 2018 (ES) ..... ES201830189

(51) Int. Cl.
*A63B 21/22* (2006.01)
*A63B 21/00* (2006.01)
*A63B 23/12* (2006.01)

(52) U.S. Cl.
CPC ..... *A63B 21/22* (2013.01); *A63B 21/225* (2013.01); *A63B 21/4033* (2015.10);
(Continued)

(58) Field of Classification Search
CPC ..... A63B 22/0056; A63B 21/4034; A63B 21/4035; A63B 21/00072; A63B 21/0058; A63B 21/22; A63B 2022/0051; A63B 71/023; A63B 69/0048; A63B 2225/09; A63B 22/0046; A63B 21/00181;
(Continued)

(56) References Cited

U.S. PATENT DOCUMENTS 4,964,632 A * 10/1990 Rockwell ..... A63B 21/0628 482/137
5,058,884 A * 10/1991 Fuller, Sr. ..... A63B 21/4047 482/137

(Continued)

*Primary Examiner* — Megan Anderson
*Assistant Examiner* — Andrew M Kobylarz
(74) *Attorney, Agent, or Firm* — ALLEN, DYER ET AL.

(57) ABSTRACT

The invention relates to a machine for sports training, which comprises a frame pivotably connected to a lever actuated by a user's arms, the at least one lever being connected to two main coupling elements situated parallel to each other, such that when the elements move, they describe an identical path at the same time, transmitting the movement of the at least one lever to resistance means. The machine provides continuous resistance to the actuation of the lever by the user, and a moment of inertia that prevents stops and jerks at the end of the stroke of the lever. The machine is provided with means for supporting the user, such as a platform, solidly fixed to the frame such that while the user trains the upper body, he or she can also train the lower body, at will, by performing exercises on the platform.

7 Claims, 3 Drawing Sheets

(52) U.S. Cl.
CPC ..... *A63B 21/4047* (2015.10); *A63B 23/12* (2013.01); *A63B 2208/0204* (2013.01)

(58) Field of Classification Search
CPC ..... A63B 21/225; A63B 22/0005; A63B 22/001; A63B 2022/0043
See application file for complete search history.

(56) References Cited

U.S. PATENT DOCUMENTS 5,304,107 A * 4/1994 Jones ..... A63B 21/0632 482/137
5,453,066 A * 9/1995 Richter, Jr. ..... A63B 69/04 482/57
5,795,270 A * 8/1998 Woods ..... A63B 21/4047 482/62
6,416,442 B1 * 7/2002 Stearns ..... A63B 22/001 482/52
6,482,133 B1 * 11/2002 Miehlich ..... A63B 22/0076 482/57
8,888,661 B2 * 11/2014 Ellis ..... A63B 22/205 482/96
9,539,460 B2 * 1/2017 Ellis ..... A63B 21/0618
10,022,586 B1 * 7/2018 Lee ..... A63B 22/0664
11,413,494 B1 * 8/2022 Habing ..... A63B 21/225
2008/0070755 A1 * 3/2008 McKee ..... A63B 22/0664 482/52
2012/0077645 A1 * 3/2012 Lee ..... A63B 22/0664 482/52
2015/0065305 A1 * 3/2015 Dalton ..... A63B 22/0056 482/52
2016/0263427 A1 * 9/2016 Mueller ..... A63B 22/0015
2016/0287933 A1 * 10/2016 Lin ..... A63B 22/0048
2019/0105530 A1 * 4/2019 Tholkes ..... A61G 5/14

* cited by examiner

MACHINE FOR SPORTS TRAINING

CROSS-REFERENCE TO RELATED APPLICATION

This application is the § 371 National Stage of International Application No. PCT/ES2019/070100, filed on Feb. 21, 2019, which claims the benefit of Spanish Application No. P201830189, filed on Feb. 28, 2018, the contents of which are herein incorporated by reference in their entirety.

FIELD OF THE INVENTION

This invention relates to the field of machines used for training body muscles. The user, standing upon support means, such as a platform, operates at least one lever pivotably connected to a frame, thereby exercising his upper body. The lever is connected to resistance means. While standing on the support means and operating the lever, the user can also exercise his lower body at will.

BACKGROUND OF THE INVENTION

Machines for the combined training of upper and lower body are known in the art. The upper body is trained by operating respective levers with the arms, such as the machines described in the documents hereinafter referenced.

US 2015/238806A1 (Hagay Mintz) 27 Aug. 2015, "Combined exercise apparatus" describes an exercise apparatus comprising a standard treadmill for lower body training and a couple of driven subparts (24A, 24B) pivoting on respective vertical struts (12A, 12B) sustantially perpendicular to the treadmill, for the simultaneous upper body training. Driven subparts (24A, 24B) may be attached to weights (40) at one of their ends.

U.S. Pat. No. 7,585,254B1 (Suzanne R. Vittone et al) Aug. 9, 2009, "Resistance band exercise machine" is of the same sort as described above, the treadmill being complemented by poles (24) pivoting on a frame (18). The poles (24) are attached to elastic bands (40) whose resistance must be overcome when the poles (24) are operated by the user.

EP0591729A2 (Wilkinson, William T.) 13 Apr. 1994, "Arm exerciser, universally adaptable to leg exercisers" comprises a treadmill whose frame has two brackets (26), and to each of them a pole (30) is attached. The brackets (26) comprise pivoting means allowing user to move poles (30) forwards and backwards and means to graduate the resistance to said movement.

In all the cited machines, the two poles are operated one independently of the other. Likewise, the poles stop suddenly, either because they have reached the end of their path or because the user stops their motion and moves them in the opposite direction. The user cannot profit from the force exerted to move a pole in one direction when he starts to move it in the opposite direction. Besides, in all those machines the poles are complementary of treadmills, therefore the user operates the poles while supporting himself on a mobile base.

US 2012/0077645 A1 (Superweigh Enterprise Co. Ltd.) 29 Mar. 2012 "Exercising device" is different to the above-cited documents in that, comprising poles, they are not operated one independently of the other, but they are linked to a mechanism operated by the user's lower body. Specifically, its subject matter is a machine to perform an exercise to simulate climbing up staircases. To this end, it comprises left and right foot engaging pedals (50) capable of moving along respective rods (43). The pedals (50) are connected, via a transmission system (32, 313, 33, 21), with levers (30, 31) and a set of flywheels (20). The movement of left and right foot engaging pedals (50) with the strength of the user's legs causes the levers (30, 31) to move forwards and backwards, the user grabbing the levers (30, 31) so that his arms can follow said movement.

US 2008/0070755 A1 (McKee et al) 20 Mar. 2008 "Machines and methods for combined and isolated upper and lower body workouts" is of the type that has been described in the earlier document. The machine comprises two levers (201, 203, 127, 251) linked to mechanisms operated by the user's lower body. Specifically, the levers comprise a handgrip portion (203, 201), connected by way of a rocker bar (127) to, on the one hand, an adjustment arm (251), in turn connected to a support of the user's feet (501); and on the other hand, a pendulum arm (125) directly coupled to resistance means (503) and therefore without any intervention of coupling elements.

In the machine which is the subject matter of US 2005/0187073 A1 (Mark A. Krull) 25 Aug. 2005 "Rowing machine with elliptical seat motion" the user, supported on a seat (144) and a foot support (116), and grabbing two handlebars (170), moves his body backwards pressing on the foot support (116), overcoming his own weight plus the resistance posed by resistance means (120, 121, 133). This movement is possible because the seat (144) is fixed to a support (140) pivotably connected to the machine's frame (110) through a pivoting bar (150), so that said support (140) describes an elliptical movement. The support (140) is attached to a fork coupled to the resistance means (120, 121, 133). Concerning the handlebars (170), two embodiments are described: in one of them (FIG. 1), the handlebars (170) are articulated by their respective lower ends to the frame (110) and have intermediate portions that are interconnected by a rigid bar on which a roller (177) is rotatably mounted. The roller (177) is disposed inside a guide (147), so that when the handlebars (170) are moved backwards, the roller (177) makes pressure of the guide (147) and contributes slightly to the backward movement of the support (140). In another embodiment (FIG. 6), the handlebards (170) are likewise pivotably connected by their respective lower ends to the frame (110), but in their intermediate portions, instead of the guide (147) and the roller (177) there is a rigid link (390) pivotably connected to the handlebars (170) and to the frame (140), thus allowing the handlebars (170) to move backwards and forwards, but this movement is not transmitted to the support (140).

In the machines described in the first three documents, the poles are complementary of a treadmill, therefore the user a compasses the motion of his legs, naturally alternative backwards and forwards, with the alternative motion of his arms. Certainly, as the poles are independent of the treadmill's motion, the user may operate the poles simultaneously backwards and forwards, moving his legs at the same time on the treadmill, or remaining still thereon. However, said machines have the shortcoming that the user cannot take advantage of the inertia generated by the motion of a pole in one direction, in order to move the pole in the opposite direction. Therefore the poles stop sharply and this may cause tension in muscles and joints. Besides, if the user remains still on the treadmill, or the more so, if he tries leg workouts, simultaneously with his moving the poles, the treadmill would move and such practice would not be safe.

The machine in the fourth above-cited document, US 2012/0077645, is meant for training the lower body almost exclusively, because the user's effort is aimed at overcoming the resistance that the set of flywhells (20) is posing to the alternative motion of the foot engaging pedals (50). Arms training, where user opts for grabbing the levers (30, 31), will be very limited, because it will consist in rhythmically following the motion of those levers (30, 31). The arms, incapable of overcoming the strength of the legs, could not by themselves move the levers (30, 31). Likewise, levers (30, 31) must necessarily be operated with an alternative motion (see paragraphs [0022] y [0023]), because legs movement is always alternative and such movement is transmitted to the levers (30, 31).

The subject matter of the fifth cited document, US 2008/0070755, is a machine primarily for working out the lower body, because the means operated by the user's arms are linked to the foot support. Specifically, the rocker bar (127) is connected on both ends to the handgrip (203, 201) and operated by the user. Therefore, the element (127) is part of the levers (201, 203, 127, 251) and cannot constitute a main coupling element, such as this element must be understood in the present invention, where said element must actuate the resistance means, whereas the element (127) actuates the element (125), which is not a resistance means, but an actuation element, since it forms part of the lever. Besides, the motion of the rocker bars (127), since it is linked to the foot supports (501), is alternative, so the rocker bars (127) do not describe the same path at the same time, that is, they are not situated with the one in parallel to the other.

The machine of cited US 2005/0187073 is meant for lower body training, because the resistance means (120, 121, 133), plus the user's own weight, are overcome basically by leg force, the movement of the levers (170) not having more that a minimal role (in the first embodiment) or none at all (in the second embodiment) in the motion of the support (140). In the first embodiment, the levers (170) move freely inside the guide (147) and are pivotably connected to the structural means (110), not to any other element which, in the terms of the present invention, could qualify as coupling elements. In the second embodiment of the rowing machine, the levers (170) are pivotably connected to the support (140) by way of the rigid links (390). But such support (140) does not qualify as actuation means (and accordingly, as a main coupling element) because in the present invention, actuation means are those that are actuated by the user when performing the upper body training whereas in the cited document, the support (140) is actuated only by the lower body. Regardless of this, and applicable to both embodiments, the support (140) is just one element, whereas the present patent claims at least two main coupling elements. The fork could not qualify as such, because it is not pivotably connected, by each of its arms, to at least one lever.

SUMMARY OF THE INVENTION

The subject matter of this patent is a sports training machine where the user operates with his arms at least one lever pivotably connected to a frame, the at least one lever being coupled to resistance means, the resistance being overcome with the effort of the upper body. The user operates the at least one lever while standing on support means, upon which means he may exercise at will his lower body.

The machine comprises structural means, actuation means, resistance means and support means. The structural means are those upon which the machine rests on the ground, the other means being either fixed to them or pivoting on them. Said structural means comprise a frame. The actuation means are operated by the user in order to train his upper body and comprise at least one lever, pivoting on the structural means, and at least two main coupling elements, to which the at least one lever is pivotably connected. "Main coupling element" must be understood as any element, such as a rod, pivotably connected to the at least one lever and that operates on the resistance means, transmitting to them the motion of the at least one lever. There may be single resistance means, in which case they would normally be located in a central position in the machine; or there may exist resistance means on both sides of the machine. Said resistance means may be of any type known in the art, or combinations thereof, such as drive pulleys, for instance, two pulleys connected by a belt or a chain, or a spiral actuating against the resistance of the air or a liquid; or a flywheel whose resistance can be graduated by friction devices such as brake pads or magnets. Likewise, the resistance means may consist of a single element (for instance, a single ring, spiral, flywheel with graduated or non-graduated resistance), therefore without transmission to any other element. Whatever their configuration, the resistance means comprise at least a main resistance element, i.e. any element operated by the at least one of the at least two main coupling elements.

Support means are those upon which the user stands in order to operate the actuation means and also, at will, exercise his lower body.

In a first embodiment, the actuation means comprise two levers. In a second embodiment, the actuation means comprise one lever. In both embodiments, the at least two main coupling elements may operate the resistance means in a direct fashion, i.e. connecting themselves to a point of the main resistance means. It is understood that said connection is direct even if a perpendicular rod is fixed to the respective ends of the main coupling elements, in order to bridge the distance existing between those ends and the resistance means. Likewise, the at least two main coupling elements may operate indirectly on the resistance means, that is, not being directly connected to the main resistance element, but actuating upon it by way of subsidiary coupling elements, for instance, crank arms.

The invention is characterized in that the at least two main coupling elements are located one in parallel to the other, which implies that when they are in motion they describe the same path at the same time.

Due to the particular disposition of the at least two main coupling elements, when the user moves the at least one lever towards himself and, the lever having reached the end of its path, the user moves it in the opposite direction, the user will encounter the same resistance in both directions, this feature increasing the efficiency of the exercise. On the other hand, the motion of the at least one lever transmits a circular motion to the resistance means, because the path of the at least one lever in one direction will transmit a 180° turn to the resistance means, which is completed when said at least one lever is moved in the opposite direction. This way, when the at least one lever reaches the end of its path in one direction, it does not stop suddenly, because the turn of the resistance means produces a moment of inertia preventing sudden stops and jerks when the lever is moved in the opposite direction. This is beneficial to the muscles, tendons and joints of the upper body involved in the exercise. Besides, the user may keep a constant speed in the motion of the levers.

The invention is also characterized in that the means to support the user are fixed to the structural means, in the sense that, while the machine is in use, said means of support do not move at all, notwithstanding the fact that they may be foldable or may be disassembled when the machine is not working. These means may be configured in different ways, such as a central platform or two lateral platforms. The user, standing upon such stationary means, may at will train his lower body by workouts such as leg flexing, in which case there is a dissociation of resistances: on the one hand, the user must overcome, using his arms, the resistance means of the machine and on the other hand, using his legs, he must overcome the resistance posed by his own body weight. Besides, where the means of support consist of a central platform, the user may place a gymnastic apparatus upon it, for instance, a device for keeping balance or a stationary bicycle. In all these cases, each part of the body can be trained independently without the respective resistances interfering with each other. Additionally, the means of support may comprise a seat fixed to the frame, upon which the user may rest his lower body while exercising his upper body.

DESCRIPTION OF EMBODIMENTS

Figure 1:
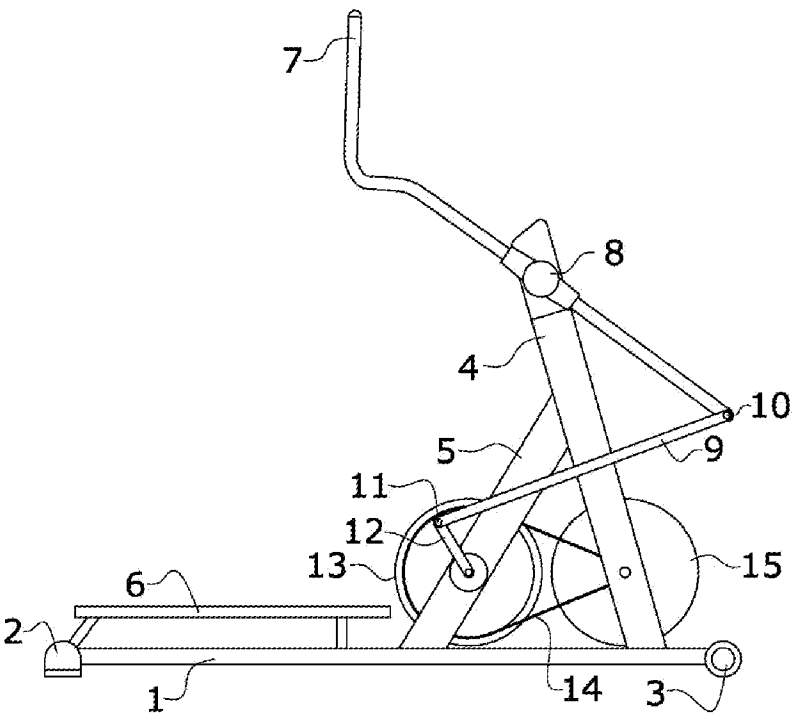
FIG. 1, a side view of the machine in a first embodiment, with two levers.

FIG. 1 shows in lateral view a first embodiment of the sports training machine which is the subject matter of this patent.

The structural means of the machine consist of a frame, which comprises a bottom beam (1) with respective feet (2, 3) fixed to its ends. A main post (4) extends upwards from the end of the beam (1) close to foot (3). The main post (4) has a forked lower end that straddles a flywhell (15). A backing post (5) extends diagonally from the main post (4) and rests on the bottom beam (1). The means for supporting the user, consisting of a central platform (6), are fixed to the bottom beam (1) and to foot (2).

Figure 2:
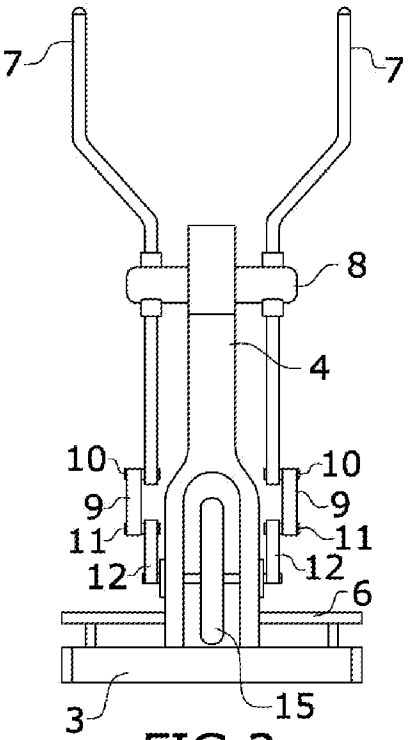
FIG. 2, a front view of same machine.

In this first embodiment, the actuation means comprise two levers (7), one on each side of the machine. The respective points of connection of the levers (7) are located in opposite sides of main post (4). The levers (7) move pivotably relative to the main post (4) through a rotatory cylinder (8) which traverses the main post. In the lower end of each of the levers (7) there are respective main coupling elements (9), pivotably connected to the levers (7) through respective first ball joints (10). The main coupling elements (9) are pivotably connected, through second ball joints (11), to respective subsidiary coupling elements, specifically two crank arms (12). As FIG. 1 is a side view, it only shows one lever (7), one main coupling element (9) and one crank arm (12), because the corresponding elements located on the opposite side, due to the machine's configuration, are at all times located in the same position as their counterparts and therefore, do not show in a side view. FIG. 2, consisting of a front view, shows the duplicity of said elements (7, 9, 12).

The resistance means, which can be viewed in their entirety in FIG. 1, in this embodiment are located in a central position relative to the main post (4) and comprise a main resistance element, namely, a crank disc (13) rotating on an axis located in the backing post (5). Said crank disc (13) is linked by way of a belt (14) to a flywheel (15), rotating on an axis traversing the fork of the main post (4). The flywheel (15) is provided with conventional devices to graduate its resistance to rotation of the crank disc (13), such as brake pads or magnets.

Crank arms (12) are pivotably connected to the axis of the crank disc (13), and in this way the main coupling elements (9) transmit the motion of the levers (7) to the crank disc (13). In this instance, the transmission is performed indirectly, due to the use of crank arms (12). The two crank arms (12) are positioned in the same geometrical radius on the opposing sides of the crank disc (13) and accordingly, the main coupling elements (9) are positioned one in parallel to the other, so that when they are in motion they will describe the same path at the same time.

In a variation of this first embodiment, the main coupling elements (9) are pivotably connected directly to the crank disc (13), that is to say, they operate on a point of said crank disc (13) instead of resorting to subsidiary coupling means (12) that operate on the axis of the crank disc (13). In order to perform this direct operation on the crank disc (13), the second ball joint (11) is pivotably connected to a segment which is perpendicular to the main coupling element (9), said segment bridging the distance between the main coupling element (9) and the crank disc (13). Specifically, the main coupling elements (9) are pivotably connected to a point in the opposing faces of the crank disc's rim (13), therefore they will be positioned one in parallel to the other and will describe identical path when they rotate in unison. Due to the location of the main coupling elements (9) and, where applicable, the subsidiary coupling elements (12), the two levers (7) must be operated simultaneously and they both move in the same direction.

The operation of the machine can be deduced from the configuration that has been described in the preceding paragraphs. When the user, standing on the platform (6), brings the two levers (7) towards himself, the main coupling elements (9), with or without the interpositon of the subsidiary coupling elements (12), confer a 180° rotation to the disc (13), and when the two levers (7) are moved in the opposite direction, the rotation reaches 360°. The rotation of the crank disc (13) and the flywheel (15), poses a resistance to the movement of the levers (7), which provides more efficient training. When the levers (7) reach the end of their path there is no sudden stop, because the crank disc (13) and the flywheel (15) produce a moment of inertia which is used to the advantage of the user when moving the levers (7) in the opposite direction.

Figure 4:
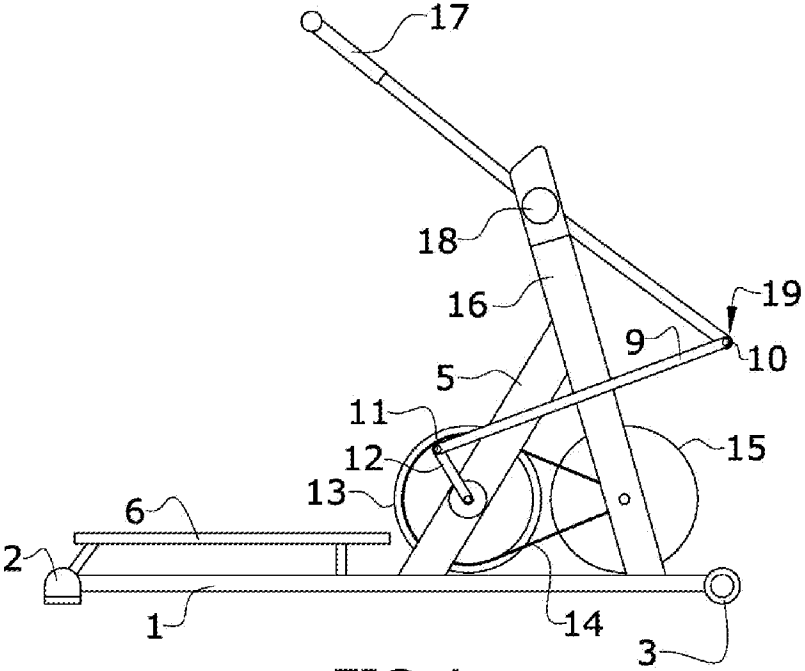
FIG. 4, a side view of the machine of FIG. 3.
Figure 3:
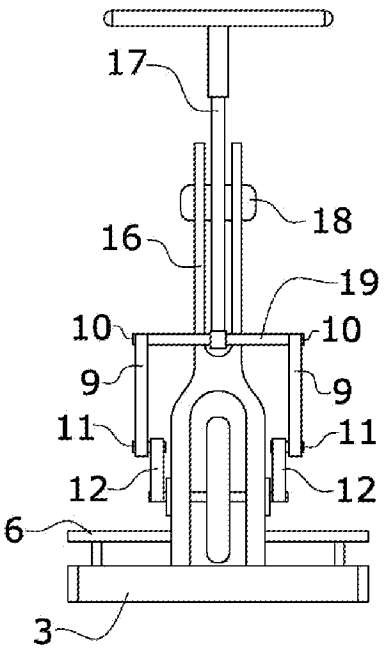
FIG. 3, a front view of the machine, in a second embodiment, with one lever.

In a second embodiment, shown in FIGS. 3 and 4, the training machine which is the subject matter of this invention comprises only one lever (17). As shown in FIG. 3, the structural means comprise a main post (16) with forked lower and upper ends. The upper forked end straddles a lever (17), which is pivotably connected to said forked upper end by way of a cylinder (18). The lever (17) is attached at its lower end to a rod (19) whose ends are pivotably connected, through first ball joints (10) to respective main coupling elements (9) identical to those described in the first embodiment. Through second ball joints (11) the main coupling elements (9) operate on a crank disc (13), connected via a belt (14) to a flywheel (15), as described in the first embodiment. This second embodiment also comprises the two modes of operation of the main coupling elements (9) on the crank disc (13): by subsidiary coupling means, such as crank arms (12), or directly on the crank disc (13) through a perpendicular segment. Due to this configuration, the main coupling elements (9) are likewise located one in parallel to the other, so when they are in motion they will describe the same path at the same time. FIG. 4 shows a side view of the element of the machine in this second embodiment.

The functioning of the machine in this embodiment is substantially the same: the user operates the lever (17) with one or two of his arms. Thanks to the rod (19), the motion of the lever (17) forwards and backwards is transmitted to both parallel main coupling elements (9), which will describe the same path at the same time, transmitting a full rotation to the resistance means (13, 14, 15).

Figure 6:
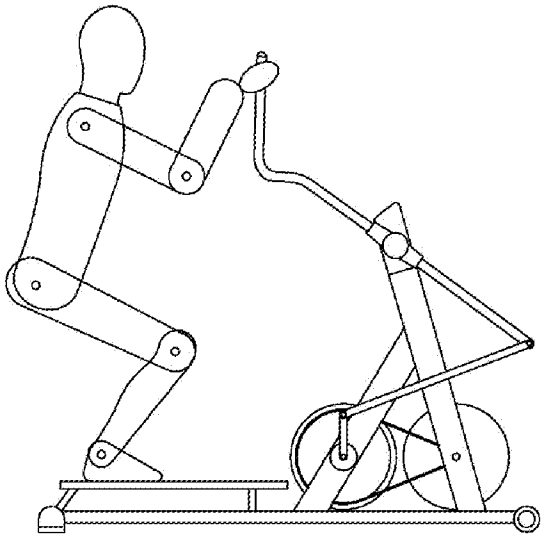
FIG. 6, a side view of the machine in the first embodiment corresponding to FIG. 1, with a schematic representation of a user in a further stage of the motion of the levers.
Figure 5:
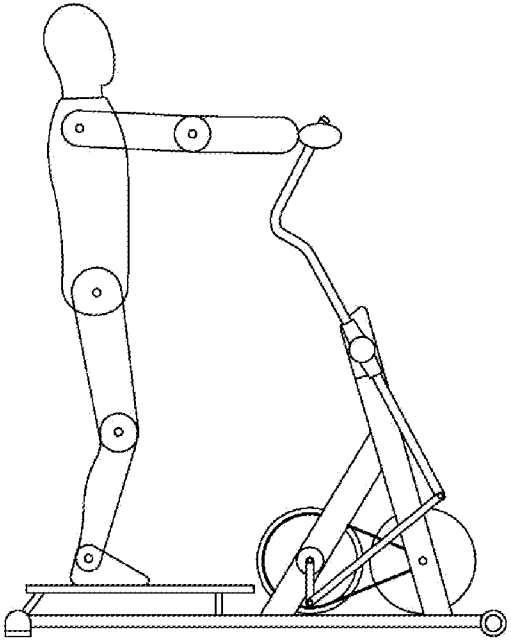
FIG. 5, a side view of a the machine in the first embodiment corresponding to FIG. 1, with a schematic representation of a user standing on a central platform, at one stage in the motion of the levers.

FIGS. 5 and 6 represent the interaction between user and machine, when the user has opted to combine training of his upper body, by operating the levers (7), with training of his lower body, flexing his legs while standing on the platform (6). Thus, in FIG. 5 user is upright on the platform (6), after having moved the levers (7) forward. Right after, the user moves the levers (7) towards himself while flexing his legs, FIG. 6 showing the culmination of said movement.

The invention claimed is:

1. A sports training machine comprising:
structural means;
actuation means;
resistance means; and
a planar standing location for a user during operation of the actuation means;
wherein the actuation means include at least one lever and at least two main coupling elements, each of which is pivotably connected with the at least one lever, and the resistance means include at least one main resistance element having an axis;
wherein the at least two main coupling elements are positioned one in parallel to the other, in that each of the at least two main coupling elements is positioned, at all times along its path, in the same position as its counterpart and in that the at least one main resistance element revolves around its axis in a circular motion of 360 degrees when motion of the at least one lever is transmitted to it through the at least two main coupling elements;
wherein no means other than the actuation means are operable by the user to move the resistance means and the actuation means are configured to be operated only by arms of a user; and
wherein the planar standing location for the user is stationary during operation of the actuation means.

2. The sports training machine according to claim 1, wherein the planar standing location for the user is fixed to the structural means.

3. The sports training machine according to claim 2, wherein the planar standing location for the user comprise a central platform.

4. The sports training machine according to claim 2, wherein the planar standing location for the user comprises two side platforms.

5. The sports training machine according to claim 1, wherein the at least two main coupling elements operate on the at least one main resistance element through respective subsidiary coupling elements.

6. A sports training machine comprising:
structural means;
actuation means; and
resistance means;
wherein the actuation means include at least one lever and at least two main coupling elements, each of which is pivotably connected with the at least one lever, and the resistance means include at least one main resistance element having an axis;
wherein the at least two main coupling elements are positioned one in parallel to the other, in that each of the at least two main coupling elements is positioned, at all times along its path, in the same position as its counterpart and in that the at least one main resistance element revolves around its axis in a circular motion of 360 degrees when motion of the at least one lever is transmitted to it through the at least two main coupling elements;
wherein no means other than the actuation means are operable by a user to move the resistance means and the actuation means are configured to be operated only by arms of a user; and
wherein the circular motion of 360 degrees is initiated by moving the at least one lever in a first direction and completed by moving the at least one lever in a second direction opposite the first direction.

7. A sports training machine comprising:
structural means;
actuation means; and
resistance means;
wherein the actuation means include at least one lever and at least two main coupling elements, each of which is pivotably connected with the at least one lever, and the resistance means include at least one main resistance element having an axis;
wherein the at least two main coupling elements are positioned one in parallel to the other, in that each of the at least two main coupling elements is positioned, at all times along its path, in the same position as its counterpart and in that the at least one main resistance element revolves around its axis in a circular motion of 360 degrees when motion of the at least one lever is transmitted to it through the at least two main coupling elements;
wherein no means other than the actuation means are operable by the user to move the resistance means and the actuation means are configured to be operated only by arms of a user; and
wherein the at least two main coupling elements operate on the at least one main resistance element through respective subsidiary coupling elements.

* * * * *